United States Patent [19]

Parein

[11] Patent Number: 4,617,001

[45] Date of Patent: Oct. 14, 1986

[54] ELEMENTS OF A CONSTRUCTION OR ASSEMBLY SET, AND ACCESSORIES

[76] Inventor: Eric W. Parein, Faiderstraat 79, Elsene, Belgium, B-1050

[21] Appl. No.: 459,572

[22] PCT Filed: May 27, 1982

[86] PCT No.: PCT/BE82/00012

§ 371 Date: Jan. 12, 1983

§ 102(e) Date: Jan. 12, 1983

[87] PCT Pub. No.: WO82/04196

PCT Pub. Date: Dec. 9, 1982

[30] Foreign Application Priority Data

Jun. 2, 1981 [BE] Belgium ..... BE 204.966
Sep. 30, 1981 [BE] Belgium ..... BE 206.117

[51] Int. Cl.[4] ..... A63H 33/08

[52] U.S. Cl. ..... 446/102; 59/80; 59/900; 59/901; 403/56; 403/90; 446/104; 446/120

[58] Field of Search ..... 46/25, 26, 31; 434/278; 446/85, 102, 120, 121, 124; 403/56, 57, 90, 114, 115, 116; 59/80, 82, 901, 900; 362/355

[56] References Cited

U.S. PATENT DOCUMENTS

| | | | |
|---|---|---|---|
| 409,744 | 8/1889 | Garben | 46/26 X |
| 2,008,791 | 7/1935 | Levy | 362/255 X |
| 2,410,874 | 11/1946 | Greenberg et al. | 446/124 X |
| 2,616,030 | 10/1952 | Van Dyke | 362/255 |
| 2,662,335 | 12/1953 | Calverly | 446/120 X |
| 2,714,269 | 8/1955 | Charles | 46/26 X |
| 2,752,726 | 7/1956 | Calverly | 446/120 X |
| 3,224,137 | 12/1965 | Wright et al. | 46/26 X |
| 3,458,949 | 8/1969 | Young | 446/124 X |
| 3,477,167 | 11/1969 | Ach | 200/51 R |
| 3,479,763 | 11/1969 | Fischer | 46/25 |
| 3,486,268 | 12/1969 | Fischer | 46/25 X |
| 3,597,874 | 8/1971 | Ogsbury et al. | 46/31 X |
| 3,747,261 | 7/1973 | Salem | 446/104 |
| 3,822,499 | 7/1974 | De Vos | 446/121 |

FOREIGN PATENT DOCUMENTS

| | | | |
|---|---|---|---|
| 100926 | 2/1965 | Denmark | 46/31 |
| EP0018658 | 11/1980 | European Pat. Off. | 446/102 |
| 1176368 | 4/1959 | France | 63/DIG. 3 |
| 1322001 | 2/1963 | France | 403/114 |
| WO80/00541 | 4/1980 | World Int. Prop. O. | 446/102 |
| 833700 | 4/1960 | United Kingdom | 59/80 |
| 1167678 | 7/1968 | United Kingdom . | |

*Primary Examiner*—F. Barry Shay
*Attorney, Agent, or Firm*—John P. Snyder

[57] ABSTRACT

Detachable links are formed by a first link having a part-spherical end joined to a cylindrical first intermediate portion and a second link having a receiving end with spaced, generally U-shaped arms defining a slot. The arms resiliently spread apart to receive and then snap back to capture the part-spherical portion, leaving the cylindrical portion in the slot. The joined links may be freely relatively pivoted through substantially 180 degrees and may be freely relatively rotated through a full 360 degrees about the axis of the cylindrical portion. The part-spherical portion may have one upstanding cylindrical stub or a diametrically opposed pair which are positionable either between the legs of the arms or in the slot between arms. These stubs limit the free rotation between links by resisting same except as permitted by forcible rotation in 90 degree steps due to spreading apart and snapping back of the arms. In one position where the stubs are located between the legs of the arms, free pivoting through 180 degrees as the cylindrical portion traverses the slot is permitted but forcible stepwise axial rotation is still required. When the stubs are in the slot pivoting is limited except as permitted by forcible pivoting in 90 degree steps. If only one stub is present, free pivoting through 90 degrees is permitted for about 90 degrees of the slot while forced pivoting through the remaining 90 degree traverse is required.

25 Claims, 13 Drawing Figures

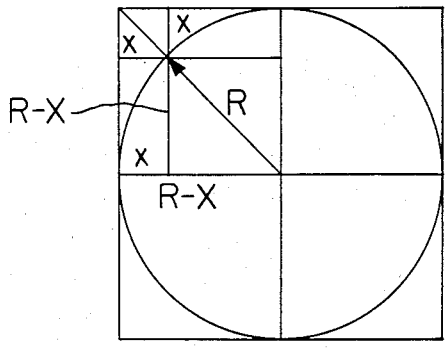
FIG. 7
FIG. 8b
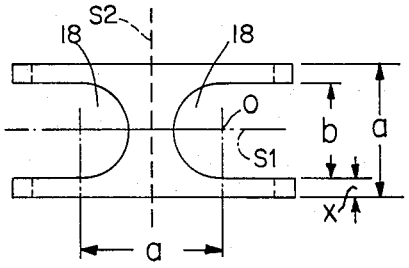
FIG. 8c
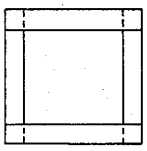
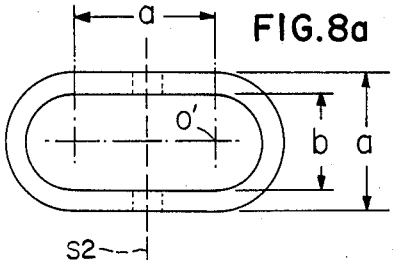
FIG. 8a
FIG. 9a
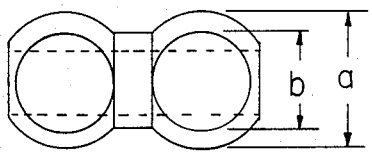
FIG. 9b
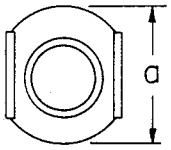
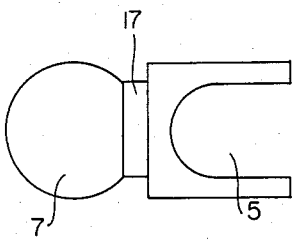
FIG. 10

ELEMENTS OF A CONSTRUCTION OR ASSEMBLY SET, AND ACCESSORIES

The invention relates to construction or assembly elements provided with coupling members serving for associating these elements with one another, and more particularly a set of construction elements suited to one another, by means of which it is possible to produce a very large number of combinations serving as toys.

For this purpose, the coupling members for the construction elements or links of the present invention consist of at least one spherical part, on the one hand, constituting a penetrating element, and at least one receptacle corresponding to the spherical parts, on the other hand, which are designed in such a way that a spherical part of one link can be locked elastically in the receptacle of another element forming the receiving link.

According to a preferred embodiment of the invention, the penetrating link has at least two identical spherical parts which are connected to one another by means of an intermediate cylindrical narrowed portion, the distance between the centres of these spherical parts being substantially equal to the diameter of the latter.

The receiving link can be formed by a single or multiple link which has at its two opposite ends receptacles which are intended for receiving spherical parts such as those mentioned above.

The abovementioned receptacle can likewise be limited on at least one of its sides by an elastically articulated lip which grips the spherical part of the coupling member located in the receptacle.

Other advantages and special features of the invention will emerge from the description given below of some specific embodiments of the construction elements according to the invention.

FIG. 7 is a graphical representation of the relative dimensions of the elements according to FIGS. 4, 5 and 6;

Figure 1:
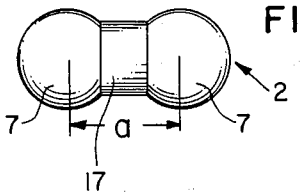
FIG. 1 is an embodiment of a penetrating link.

FIG. 8*a* is a top view of a receiving link;

FIG. 8*b* is a front view of a receiving link;

FIG. 8*c* is a side view of a receiving link;

FIG. 9*a* is a top view of a penetrating link;

FIG. 9*b* is a side view of a penetrating link; and

FIG. 10 is an alternative embodiment.

In the various figures, the same reference numerals denote identical or similar elements.

The penetrating link 2 illustrated in FIG. 1 is provided with two spherical parts 7 which are fixed to one another by means of a cylindrical intermediate piece 17 in such a way that a cylindrical outer surface is formed between these parts 7. The distance "a" between the centres of these spherical parts is approximately equal to the diameter of the latter.

Figure 2:
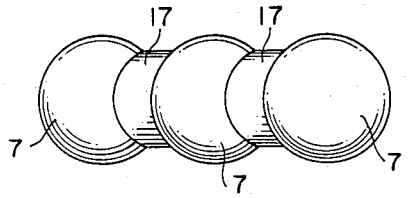
FIGS. 2 and 3 are perspective representations of special forms of the penetrating links.
Figure 3:
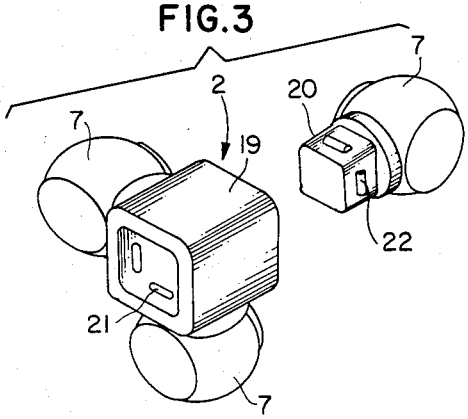

FIG. 2 shows three spherical parts fixed to one another by intermediate pieces 17, whilst FIG. 3 shows a penetrating link 2 consisting of a cubic box 19 to which, for example, two spherical parts are fixed at right angles to one another, whilst in the two open ends of the box it is possible to mount two spherical parts 7 removably by means of a connector 20 which can be slipped into this box 19.

This connector has ribs 22 on its side faces which interact with corresponding notches 21 which are made in the inner walls of the box and which therefore make it possible to retain the connector sufficiently firmly in the box in a removable manner.

The length of the connector 20 is at most equal to half the length of the box 19, so that it is possible to fix to it, at the same time, a spherical part 7 in both ends.

It is therefore possible, on this special element, to build in different directions at right angles to one another.

Figure 4:
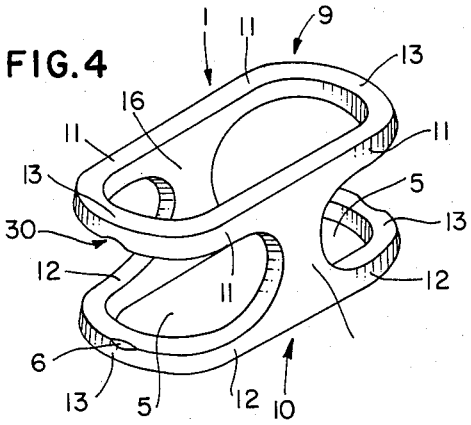
FIGS. 4, 5 and 6 show respectively in perspective a receiving link, a modified penetrating link and their assembly, FIG. 6 including a partial cutaway portion.
Figure 5:
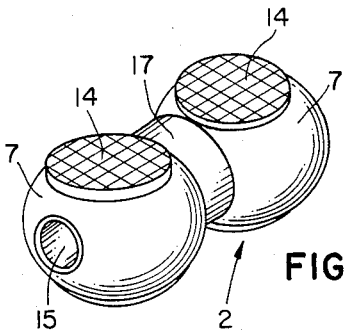
Figure 6:
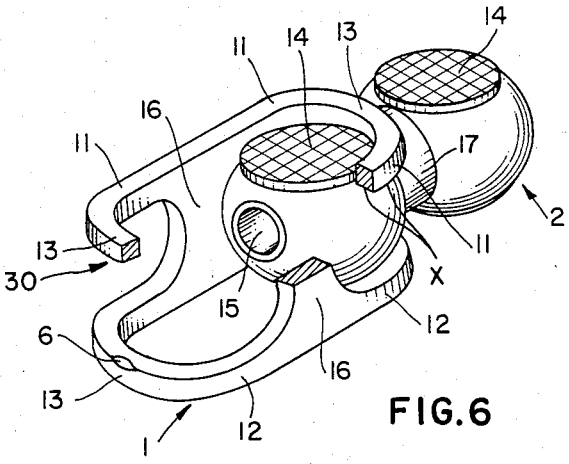

In the embodiment shown in FIGS. 4, 5 and 6, a receiving link 1 is formed by a link which has at its two opposite ends receptacles 5 for the spherical parts 7 of a penetrating link 2.

This link 1 consists of two H-shaped parts 9 and 10 parallel to one another and spaced from one another at a distance which is a little less than the diameter of a spherical part 7, so that the latter can be locked between the branches or legs 11 and 12 of these H-shaped parts 9 and 10.

For this purpose, the branches or legs 11 and 12 of the H-shaped part 9 are connected elastically to the corresponding branches or legs 11 and 12 of the H-shaped part 10 opposite to them, so as to form receptacles 5 for the spherical parts 7.

In the embodiment according to FIGS. 4 and 6, only the free ends of the branches 11 and branches 12 of the two H-shaped parts 9 and 10 are connected two by two by curved intermediate pieces or bights 13 which are located in the plane of the corresponding branches. It will be noted that portions 11, 13, 11 form generally U-shaped arms extending from opposite ends of link 1, and portions 12, 13, 12 form generally U-shaped arms extending from opposite ends of link 1, these latter arms being parallel with the first mentioned arms.

To make it easier for the penetrating link 2 to penetrate, notches 6 can be provided in the curved pieces 13, as shown in FIGS. 4 and 6.

It will also be noted that the surfaces delimited respectively by the branches 11 and the upper curved parts 13, on the one hand, and by the branches 12 and the lower curved parts 13, on the other hand, can be solid and can serve as an advertising medium or the like.

Advantageously, at least some of the spherical parts 7 are provided with locking members which make it possible to limit the rotary movement of the spherical part in question in a receptacle 5 of the receiving element.

In the embodiment according to FIGS. 5 and 6, a locking member of this type is formed by a circular shoulder 14, the centre of which is located on an axis perpendicular to that on which the centres of the two spherical parts 7 of the penetrating element 2 are located.

The height of the shoulder 14 is at most limited by the plane tangent to the spherical part 7 at the centre of this shoulder; it is therefore possible for the latter to be located lower down.

Furthermore, the penetrating link according to FIGS. 5 and 6 has a cylindrical cavity 15, the axis of which is located on the axis connecting the centres of the two spherical parts, this cavity opening at its two ends onto the outer surface of these spherical parts 7.

In some embodiments, the centre of this shoulder can be located on the same axis as that connecting the centres of the two spherical parts.

In other cases, shoulders diametrically opposite one another can be provided on one and the same spherical part 7.

In yet other cases, only one shoulder need be provided on one of the spherical parts.

The centres of the various shoulders can also be located on one and the same axial plane of the penetrating element, or the centres of the shoulders of one of the spherical parts can be located in an axial plane perpendicular to the axial plane containing the centres of the shoulders of the other spherical part.

In the embodiment according to FIGS. 5 and 6, two shoulders, the centres of which are diametrically opposite one another and are located in one and the same axial plane, have been provided on each of the spherical parts.

The rotary movement of the penetrating link 2 in relation to the receiving element 1 is limited as a function of the position of the locking member, more specifically of the shoulder 14, on the spherical part.

Thus, for example, according to FIG. 6, the penetrating element 2 can experience rotation only along a single axis parallel to the webs 16 of the H-shaped parts 9 and 10. If the centre of the shoulder is located on the axis connecting the centres of the spherical parts, that is to say on the same axis as the cavity 15, the penetrating element 2 can then rotate only about the axis of this cylindrical cavity.

It is clear that what has just been described in relation to the shoulders can apply to all embodiments of the penetrating link, particularly to the embodiments shown in FIGS. 2, 3 and 5.

In order to reduce to a minimum the free play between the various construction elements connected to one another and therefore to obtain an exact linking-up of these elements, together with a maximum number of combination possibilities, it is important that the relative dimensions of the receiving elements and penetrating elements should satisfy specific conditions.

These dimensions are shown graphically in FIGS. 7, 8 and 9.

Thus, it is important that the external distance a between the H-shaped parts should be approximately equal to the diameter of the spherical parts 7 and that the internal distance b between the latter should be approximately equal to the diameter of the narrowed portion 17 between the two consecutive spherical parts 7. Furthermore, the width of the H-shaped parts is approximately equal to the diameter of the spherical parts 7 and constitutes two receptacles 5 opposite to one another for receiving the spherical parts, the H-shaped parts being produced in such a way that the centres of the spherical parts are located in these receptacles spaced from one another at a distance equal to their diameter.

The space 18 between the web 16 and the base of the branches which are connected on one side to this web has the shape of a semi-circle, the radius of which corresponds approximately to that of the circular shoulder 14. The centre O of this semi-circle is located in the longitudinal plane of symmetry $S_1$ of the H-shaped parts 9 and 10 perpendicular to the web 16 and at a distance from the centre of the latter which is approximately equal to the radius of the spherical parts.

Said curved intermediate pieces 13 also have approximately the shape of a semi-circle, the radius of which is approximately equal to that of the circular shoulder 14 and the center O′ of which is located in the middle between the two H-shaped parts 9 and 10 at a distance from the transverse plane of symmetry $S_2$ which is approximately equal to the radius of the spherical parts. The centres O and O′ are therefore located in one and the same plane, parallel to the plane of symmetry $S_2$.

The distance x, which is one-half the quantity a minus b conforms approximately to the following equation:

$$x = R\left(1 - \frac{1}{\sqrt{2}}\right)$$

in which x is the depth of the narrowed portion and R is the radius of the spherical parts 7. This formula is illustrated graphically in FIG. 7. By inspection, the triangle illustrated is an isosceles triangle in which its two sides are $R-x$ or the radius of the cylindrical portion 17, so that $R-x/R=\frac{1}{2}$.

On the basis of this formula it is possible to determine all the dimensions both of the receiving element 1 according to FIG. 4 and of the penetrating link 2 according to FIG. 5. Thus the branches 11 and 12 of the H-shaped parts have a square cross-section, the side of which is equal to x.

As regards FIG. 4, it is clear that if an excess thickness is provided to close, for example, the upper surface delimited by the curved part 13 and the branches 11, the dimensions must take this excess thickness into account.

The receptacles 5 have a penetration aperture or slot 30 for the spherical parts 7, of which the smallest width corresponding to the internal distance between the intermediate pieces 13 is equal to the diameter of the spherical parts less twice the depth x of the narrowed portion 17 mentioned.

The foregoing description made with reference to FIGS. 4 to 9 applies accordingly to the embodiments of FIGS. 2 and 3 which relate to penetrating elements 7 serving to form T-shaped or angular connections with receiving elements 1 (not shown).

It goes without saying that it is possible to envisage yet other forms of penetrating elements or receiving elements.

Thus, for example, the links can be single, as in FIG. 4, or multiple. As regards multiple links, these can consist, for example, of two or more single links joined to one another.

The link elements 1 of FIG. 4 can be assembled into an open or closed chain or into a branched construction by alternately connecting a penetrating element and a receiving element which are connected to one another.

Depending on the type of spherical parts 7 and their relative position in the receptacles 5, it is possible to obtain a completely rigid assembly, a partially rigid assembly or a completely flexible assembly and to limit the relative angular movements and the relative position of the circular shoulder 14 in relation to the receptacle 5. That is to say, if two links are joined as in FIG. 6, with a stub or shoulder 14 or diametrically opposed stubs positioned between the legs 11, 12 of the arms, against the bights 13, these two links are free to pivot in the plane to which the arms are parallel with the portion 17 traversing through the slot 30 between the arms. In this case, the two links are free to pivot through an angle of approximately 180 degrees as the cylinder traverses the slot, just as when the penetrating link has no stubs as in FIG. 1, but relative rotation therebetween about the axis of the cylinder 17 requires forcible rotation in 90 degree steps instead of the free rotation as presented by the FIG. 1 form. If there is but one stub 14 on a part-spherical portion 7 and the two links are joined so that this stub is positioned in the slot between the arms (e.g., rotated 90 degrees from the position shown in FIG. 6), then the two links are still free to pivot in the aforesaid plane but only through an angle of about 90 degrees while the remaining 90 degrees of traverse of the cylinder in the slot requires a forcible pivoting. Again, forcible rotation about the axis of the cylinder is required. Lastly, if there are two stubs 14 on the part-spherical portion 7 and the two links are joined so that the two stubs or shoulders 14 are positioned in the arcuate ends of the slots, neither free pivoting nor free rotation is possible between these two links and the forcible pivoting and forcible rotation, as above, is required.

It is appropriate to note that many alternative embodiments of the invention arising from the principle claimed are possible. Thus, it is possible to conceive a link such as that shown in FIG. 10, which comprises a single receptacle 5. Links of this type can be linked up by making a spherical part 7 of a first element penetrate into the receptacle 5 of an adjacent link (not shown). However, this alternative embodiment is more difficult to produce by the injection of resins.

I claim:

1. A detachable link type of device which comprises:

a first link having opposite end portions connected by a first intermediate portion and a second link having opposite end portions connected by a second intermediate portion, one end portion of the first link having a spherical surface portion and the first intermediate portion being in the form of a cylinder joined to said one end portion to define a cylindrical, annular surface immediately adjacent said one end portion;

one end portion of said second link being adapted to receive and capture said one end portion of the first link in snap-fit relation, said one end portion of the second link including a pair of generally U-shaped and parallel arms extending from said second intermediate portion and which are spaced apart a distance less than the diameter of said spherical surface portion to define a slot therebetween, each of said arms including a bight, said slot being of a width substantially equal to the diameter of said cylinder and said arms being resiliently deformable to spread apart and pass said spherical surface portion therebetween and then snap back toward said cylinder to capture said spherical surface portion of the first link, said slot extending from said intermediate portion on one side of said second link to the intermediate portion on the other side of said second link and being of substantially uniform width, the ends of said slot at said intermediate portion being arcuate to define first seat portions for line contact with said part-spherical portion, the inner sides of the bights of said arms defining second seat portions for line contact with said part-spherical portion and said first and second seat portions being located with respect to each other so as to capture and hold said part-spherical portion while said cylindrical portion is disposed within said slot.

2. A detachable link type of device as defined in claim 1 wherein said arms are of substantially square cross section of side dimension x, the radius of said spherical surface portion being R and the radius of said cylinder being $R-x$ where x is approximately equal to $R(1-1/\sqrt{2})$.

3. A detachable link type device as defined in claim 1 wherein each link is of a height substantially equal to the diameter of said spherical surface portion.

4. A detachable link type of device which comprises:

a first link having opposite end portions connected by a first intermediate portion and a second link having opposite end portions connected by a second intermediate portion, one end portion of the first link having a spherical surface portion and the first intermediate portion being in the form of a cylinder joined to said one end portion to define a cylindrical, annular surface immediately adjacent said one end portion;

one end portion of said second link being adapted to receive and capture said one end portion of the first link in snap-fit relation, said one end portion of the second link including a pair of generally U-shaped and parallel arms extending from said second intermediate portion and which are spaced apart a distance less than the diameter of said spherical surface portion to define a slot therebetween, said slot being of a width substantially equal to the diameter of said cylinder and said arms being resiliently deformable to spread apart and pass said spherical surface portion therebetween and then snap back toward said cylinder to capture said spherical surface portion of the first link, said spherical surface portion being provided with a cylindrical stub upstanding therefrom and having an axis radial to said spherical surface portion and perpendicular to the axis of said cylinder, said stub being of a diameter substantially equal to the width of said slot and comprising means for coacting with said arms for permitting relative rotation of said links about their longitudinal axes only in forcible stepwise fashion.

5. A detachable link type of device as defined in claim 4 wherein said spherical surface portion is provided with a second upstanding cylindrical stub in diametrically opposed relation to the stub first mentioned.

6. A detachable link type of device as defined in any one of claims 1, 4 or 5 wherein the other end portion of said first link is identical to said one end portion thereof.

7. A detachable link type of device as defined in any one of claims 1, 4 or 5 wherein the other end portion of said second link is identical to said one end portion thereof.

8. A detachable link type of device as defined in claim 6 wherein the other end portion of said second link is identical to said one end portion thereof.

9. A detachable link type of device as defined in any one of claims 1, 4 or 5 wherein the other end portion of said first link is identical to said one end portion of the second link.

10. A detachable link type of device as defined in any one of claims 1, 4 or 5 wherein the other end portion of said second link is identical to said one end portion of said first link.

11. A detachable link type of device which comprises:

a first link having opposite end portions connected by a first intermediate portion and a second link having opposite end portions connected by a second intermediate portion;

one end portion of the first link having a spherical surface portion and the first intermediate portion being in the form of a cylinder joined to said one end portion to define a cylindrical, annular surface immediately adjacent said one end portion; and one end portion of said second link being adapted to receive and capture said one end portion of the first link in snap-fit relation, said second intermediate portion comprising a pair of parallel webs having inner surfaces spaced apart a distance less than the diameter of said spherical surface portion and one side edge of each web providing a seat for said spherical surface portion, said one end portion of the second link comprising a pair of generally parallel branches extending from and in the plane of each web and adjacent the opposite ends thereof, the branches at one end of the two webs being joined by a first intermediate piece and the branches at the opposite two ends of the webs being joined by a second intermediate piece so that the joined branches define a slot extending from the one side edge of one web to the one side edge of the other web, said slot being of substantially uniform width, said slot being of a width substantially equal to the diameter of said cylinder and said branches being resiliently deformable to allow said first and second intermediate pieces to spread apart to pass said spherical surface portion therebetween and then snap back toward and substantially into engagement with said cylinder, the ends of said slot at said webs being arcuate to define first seat portions for line contact with said spherical surface portion, the inner sides of said intermediate pieces defining second seat portions for line contact with said spherical surface portion, and said first and second seat portions being located with respect to each other so as to capture and hold said spherical surface portion while said cylinder is disposed within said slot.

12. A detachable link assembly comprising a first link having a penetrating end and a second link having a receiving end, said penetrating end being in the form of a part-spherical surface and having a cylindrical first intermediate portion joined thereto, said receiving end being in the form of a pair of U-shaped arms spaced apart substantially in accord with the diameter of said cylindrical portion to define a slot and having a second intermediate portion joined thereto, each of said arms having two leg portions joined by a bight portion and the free ends of the legs of one arm being joined to the corresponding free ends of the legs of the other arm so that the arms are spreadable with respect to each other to pass said spherical penetrating end and then to snap back to capture said said penetrating end with said cylindrical intermediate portion being received within said slot, said slot extending from said second intermediate portion on one side of said second link to the second intermediate portion on the other side of said second link and being of substantially uniform width, the ends of said slot at said second intermediate portion being arcuate to define first seat portions for line contact with said part-spherical portion, the inner sides of the bights of said arms defining second seat portions for line contact with said part-spherical portion and said first and second seat portions being located with respect to each other so as to capture and hold said part-spherical portion while said cylindrical portion is disposed within said slot.

13. A detachable link assembly as defined in claim 12 wherein said part-spherical surface is entirely spherical except where it joins said cylindrical intermediate portion whereby said links are free to pivot with respect to each other with said cylindrical portion traversing said slot and also to rotate freely with respect to each other about the axis of said cylindrical portion.

14. A detachable link assembly comprising a first link having a penetrating end and a second link having a receiving end, said penetrating end being in the form of a part-spherical surface and having a cylindrical first intermediate portion joined thereto, said receiving end being in the form of a pair of U-shaped arms spaced apart substantially in accord with the diameter of said cylindrical portion to define a slot and having a second intermediate portion joined thereto, each of said arms having two leg portions joined by a bight portion and the free ends of one arm being joined to the corresponding free ends of the legs of the other arm so that the arms are spreadable with respect to each other to pass said spherical penetrating end and then to snap back to capture said said penetrating end with said cylindrical intermediate portion being received within said slot, said part-spherical surface being provided with a cylindrical stub upstanding radially therefrom and having an axis perpendicular to the axis of said cylindrical portion, said stub comprising means for coacting with said arms to permit relative rotation of said links with respect to each other about their longitudinal axes only in forcible stepwise fashion.

15. A detachable link assembly as defined in claim 14 wherein said stub is disposed within said slot.

16. A detachable link assembly as defined claim 14 wherein said part-spherical surface is provided with a second cylindrical stub upstanding therefrom and diametrically opposed to the first mentioned stub.

17. A detachable link assembly as defined in claim 16 wherein said stubs are received in said slot to permit relative rotation between said links only in forcible stepwise fashion as said cylindrical portion traverses within said slot.

18. A detachable link assembly which comprises at least a pair of separable links, one of said links including penetrating means for insertion into a second link in either of two different relative orientations, the second link including receiving means for detachably capturing the penetrating means while allowing free relative motion between said links when said penetrating means is captured therein in one of said relative orientations and for coacting with structure on said penetrating means to permit only forcible stepwise relative motion therebetween when said penetrating means is captured therein in the other of said relative orientations.

19. A detachable link assembly as defined in claim 18 wherein said relative motion is in a predetermined plane.

20. A detachable link assembly as defined in claim 18 including a plurality of said links forming a chain, at least one pair of said links being joined in one of said relative orientations and another pair of said links being joined in the other of said relative orientations.

21. A detachable link assembly as defined in claim 18 wherein said penetrating means comprises a part-spherical surface having a cylindrical portion joined thereto, said receiving means comprising a pair of spaced U-shaped arms in which the spacing between the arms is substantially the diameter of said cylindrical portion.

22. A detachable link assembly as defined in claim 21 wherein each arm presents a pair of legs joined by a bight portion, the spacing between the legs of each arm being substantially equal to said diameter of said cylindrical portion, said arms being of substantially square cross section of side dimention x, the radius of said part-spherical surface being R and the radius of said cylindrical portion being $R-x$ where x is approximately equal to $R(1-1/\sqrt{2})$.

23. A detachable link assembly as defined in claim 22 wherein the height and width of each link is approximately equal to the diameter of said part-spherical portion.

24. A detachable link assembly which comprises at least a pair of separable links, one of said links having a part-spherical penetrating end portion, a cylindrical first intermediate portion and a first opposite end portion, the other of said links having a receiving end portion, a second intermediate portion and a second opposite end portion, each of said links being of a length slightly greater than twice the diameter of said part-spherical portion and having both a width and a height substantially equal to the diamter of said part-spherical portion, said receiving end portion comprising a pair of U-shaped arms having ends extending from said second intermediate portion to define a slot therebetween and each of said arms including a bight, said arms being resiliently deformable so as to spread apart to pass said part-spherical portion and then snap back to trap said cylindrical portion therebetween, said slot being of a width substantially equal to the diameter of said cylindrical portion and of a length sufficient to allow about 180 degrees of pivotal motion between said links while said cylindrical portion traverses within said slot, said slot being of substantially uniform width, said second intermediate portion at the ends of said slot being arcuate and providing a first seat against which said part-spherical portion engages with line contact and the bights of said arms providing a second seat against which said part-spherical portion engages with line contact so as to allow 360 degrees of rotation between said links about the axis of said cylindrical portion.

25. A detachable link assembly which comprises at least a pair of separable links, one of said links having a part-spherical penetrating end portion, a cylindrical first intermediate portion and a first opposite end position, the other of said links having a receiving end portion, a second intermediate portion and a second opposite end portion, each of said links being of a length slightly greater than twice the diameter of said part-spherical portion and having both a width and a height substantially equal to the diameter of said part-spherical portion, said receiving end portion comprising a pair of U-shaped arms having ends extending from said second intermediate portion to define a slot therebetween and each pair of arms being joined by a bight, said arms being resiliently deformable so as to spread apart to pass said part-spherical portion and then snap back to trap said cylindrical portion therebetween, said slot being of a width substantially equal to the diameter of said cylindrical portion and of a length sufficient to allow about 180 degrees of pivotal motion between said links while said cylindrical portion traverses within said slot, said second intermediate portion providing a first seat against which said part-spherical portion engages and the bights of said arms providing a second seat against which said part-spherical portion engages so as to allow 360 degrees of rotation between said links about the axis of said cylindrical portion, said part-spherical portion being provided with an upstanding cylindrical stub having an axis radial to said part-spherical portion and perpendicular to the axis of said cylindrical portion, said stub being of a diameter substantially that of said cylindrical portion and comprising means for coacting with said arms for requiring certain rotations between said links to be effected in forcible stepwise fashion.

* * * * *